United States Patent [19]

Rothman et al.

[11] Patent Number: 4,818,486

[45] Date of Patent: Apr. 4, 1989

[54] LOW THERMAL EXPANSION SUPERALLOY

[75] Inventors: Michael F. Rothman, Kokomo, Ind.; Hani M. Tawancy, Dhahran, Saudi Arabia

[73] Assignee: Haynes International, Inc., Kokomo, Ind.

[21] Appl. No.: 141,742

[22] Filed: Jan. 11, 1988

[51] Int. Cl.[4] ..... C22C 19/05

[52] U.S. Cl. ..... 420/442; 148/410; 420/443; 420/445; 420/453

[58] Field of Search ..... 420/443, 453, 442, 445; 148/410, 427, 428

[56] References Cited

U.S. PATENT DOCUMENTS 4,118,223 10/1978 Acuncius et al. ..... 420/443

*Primary Examiner*—R. Dean

*Attorney, Agent, or Firm*—Joseph J. Phillips

[57] ABSTRACT

Disclosed is a nickel-base alloy having a low coefficient of thermal expansion and a high degree of corrosion and oxidation resistance for use without a coating. The high strength alloy is not notch sensitive under impact and has very short term ordering to $A_2B$ structure in aging. The alloy nominally contains, in weight percent, 8 chromium, 25 molybdenum, about 0.003 boron, about 1 iron, about 0.5 manganese, about 0.4 silicon and the balance nickel plus normal impurities.

3 Claims, 1 Drawing Sheet

FIG. 1 COMPARATIVE COEFFICIENTS OF THERMAL EXPANSION FOR VARIOUS ALLOYS
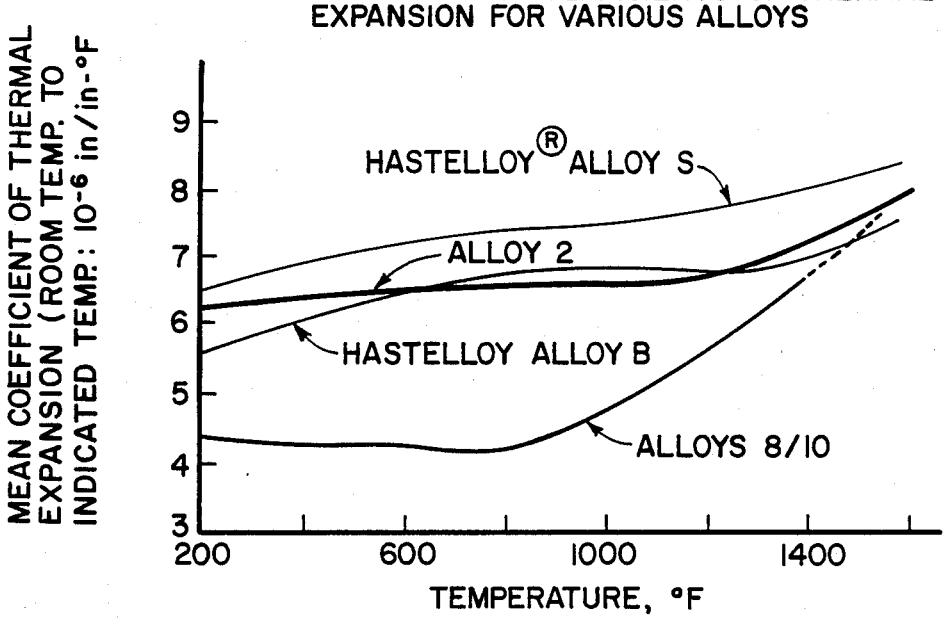
MATERIAL CONDITION: ALLOY 2 AND ALLOYS 8/10 ARE IN AGED CONDITION, OTHERS IN ANNEALED CONDITION
FIG. 2 INFLUENCE OF Mo CONTENT IN Ni-Mo-8%Cr ON MEAN COEFFICIENT OF THERMAL EXPANSION (78 - T°F)
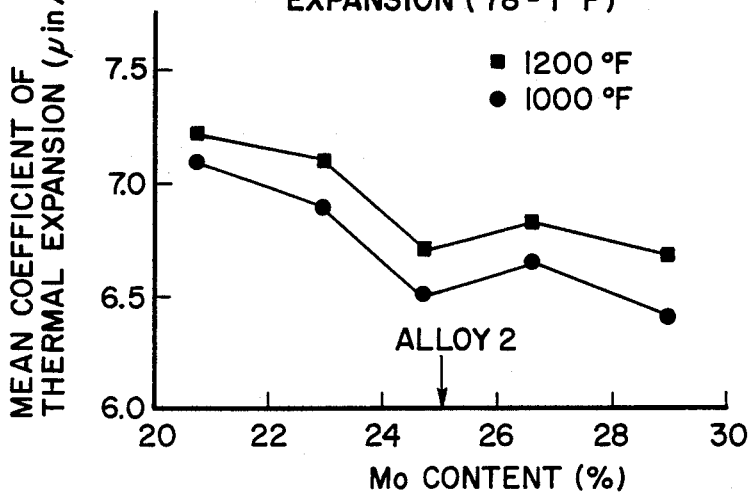

LOW THERMAL EXPANSION SUPERALLOY

This invention relates to a nickel-base alloy having a low coefficient of thermal expansion and, more specifically, to an alloy containing molybdenum and chromium critically proportioned as the principal elements in a nickel base.

BACKGROUND AND PRIOR ART

In gas turbine engines, the high degree of performance is very critically dependent upon the physical and mechanical properties of its component parts; for example, seals, casings, seal shroud support rings shafts and the like. These parts must have very critical thermal expansion and strength characteristics to ensure efficient performance of the engine. Thermal stability and aging are equally critical properties for efficient service.

A major portion of the known highly alloyed or superalloy nickel-base alloys was an outgrowth of the basic "80–20" nickel-chromium alloy. Many developments were made to the basic 80–20 system with additions of one or more modifying elements, such as tungsten and molybdenum, to improve certain properties of the alloy. Thus, the prior art is replete with nickel-base alloys containing about 15 to 25% chromium and up to about 12% modifying elements, especially molybdenum.

Known in the art for use in the production of various engine parts are three prior art alloys as described in Table 1. The alloy compositions appear to be similar. The criticality of seemingly minor compositional differences is evident as each alloy excels in specific properties. Because of this, there is an urgent need for an alloy that provides a favorable combination of various properties.

An alloy with a broad range of properties would be suited for other severe service uses such as (1) parts for rocket engine thrust chambers and fuel manifolds; (2) high strength fasteners; (3) high temperature springs and (4) dissimilar welding and repair of gas turbine and fossil power plants.

It is still another object of this invention to provide an alloy that is readily produced and readily age hardened for maximum properties.

TABLE 1

| | NOMINAL COMPOSITION (WT %) OF PRIOR ART ALLOYS | | |
|---|---|---|---|
| ELEMENT | ALLOY 9 | ALLOY 10 | ALLOY 8 |
| Ni | 38.4 | 38.2 | 38.0 |
| Co | 13.0 | 13.0 | 15.0 |
| Fe | BAL | BAL | BAL |
| Cb | 4.7 | 4.7 | 3.0 |
| Ti | 1.5 | 1.5 | 1.4 |
| Al | .03 | .03 | 0.9 |
| Si | .1 | .4 | .1 |

BRIEF DESCRIPTION OF THE DRAWINGS

FIG. 1 is a graphic presentation of the coefficient of thermal expansion for various alloys.

FIG. 2 is a graphic presentation of the influence of molybdenum in a nickel-base alloy.

THE INVENTION

The objects of this invention as stated above, and other objectives and benefits are provided by the alloy as described in Table 2.

The alloy has unique long-range ordering characteristics. It has excellent ordering characteristics after an aging time of only 24 hours.

The alloy has low thermal expansion characteristics with high impact strength after long-term aging.

The alloy is not notch sensitive in notched rupture tests.

The alloy does not require a coating to resist long-term thermal damage, i.e., oxidation.

The excellent engineering properties of the alloy are provided by the close control of composition and especially the critical molybdenum plus tungsten to chromium ratio. As indicated in Table 2, the ratio of Mo+W:Cr must be between 2:1 and 7:1, or preferably between 2:1 and 6:1. This is in direct opposition to the 80 Ni - 20 Cr concept. In this invention there is a minor addition of chromium to a nickel-molybdenum base.

TABLE 2

| | ALLOY OF THIS INVENTION COMPOSITION, WEIGHT PERCENT | | |
|---|---|---|---|
| | BROAD RANGE | NARROW RANGE | TYPICAL |
| C | UP TO .3 | 0.02–0.06 | ABOUT 0.04 |
| Cr | 5–12 | 7–9 | ABOUT 8 |
| Mo | 10–30 | 10–26 | ABOUT 25 |
| Mo + W | 22–40 | 22–40 | ABOUT 25 |
| Al | 1.0 MAX | 0.5 MAX | ABOUT 0.2 |
| B | TRACE TO .015 | .002–.006 | ABOUT .003 |
| Fe | 5 MAX | 2.0 MAX | ABOUT 1.0 |
| Mn | 2 MAX | 0.8 MAX | ABOUT 0.5 |
| Si | 1.2 MAX | 0.8 MAX | ABOUT 0.4 |
| Re | 0.1 MAX | 0.07 MAX | ABOUT 0.03 |
| Ni | BALANCE | BALANCE | BALANCE |
| RATIO (Mo + W) Cr | 2–7.0 | 2–6 | ABOUT 3 |

OBJECTS OF THE INVENTION

It is the principal object of this invention to provide an alloy that has a valuable combination of desirable physical and mechanical properties.

It is another object of this invention to provide an alloy especially suitable for use under severe service conditions and requiring a low coefficient of thermal expansion, thermal stability and oxidation resistance.

It is well known in the art that molybdenum and tungsten are interchangeable in many alloy systems. In the alloy of this invention, these elements may be interchanged. Because of the lower cost of molybdenum and the high weight and metal working characteristics of tungsten, molybdenum is preferred. Thus, molybdenum may be present in the alloy of this invention at not less than 10% for optimum economic and technical benefits.

It is well known in the art that a composition adjustment must be made because of the difference in the atomic weights of these elements, defined as about Mo=½W. For example, to obtain the equivalent of 25% molybdenum, it is necessary to have 10% molybdenum and 30% tungsten. Because of the possible interchange, molybdenum plus tungsten may total 22 to 40% in the alloy of this invention.

Boron may be present in the alloy of this invention in a small, but effective trace content up to about 0.015% to obtain certain benefits as is known in the art.

Other elements may be present in the alloy of this invention as adventitious impurities or deliberate additions for certain benefits known in the art. Such benefits may be oxidation step, reduce cost, improve ductility or fluidity and the like. To name a few such elements: aluminum, iron, manganese, silicon and rare earth metals such as cerium, lanthanum, yttrium, etc., may be present up to the contents shown in Table 2.

The compositions in Table 2 contain nickel plus impurities as balance. In the production of nickel alloys of this class, impurities from many sources are found in the final product. These so-called "impurities" are not necessarily always harmful and some may actually be beneficial or have an innocuous effect, for example, cobalt and aluminum.

Some of the "impurities" may be present as residual elements resulting from certain processing steps, or be adventitiously present in the charge materials; for example, calcium, magnesium, vanadium, zirconium and the like.

In actual practice, certain impurity elements are kept within established limits with a maximum and/or minimum to obtain uniform products as is well-known in the art and skill of melting and processing these alloys. Sulfur, phosphorous and zinc must generally be kept at low levels.

Thus, the alloys of this invention may contain these and other impurities within the limits usually associated with alloys of this class, and as recited in commercial specifications.

EXPERIMENTAL TESTING AND EXAMPLES OF THE INVENTION

Experimental heats to define the invention were made in 100 pound heats in a vacuum induction melting furnace. The heats were cast into two 2¾" diamenter electrodes. The electrodes were subsequently electroslag remelted into 4" diameter ingots. The ingots were forged down to about 1¾" thick×4" wide slabs. The slabs were then hot-rolled to ½" thick×6½" wide×length plates. The plates were annealed and aged to achieve desired strengthening. Plates were sampled along transverse direction to determine suitable physical and mechanical property data.

The ease of melting and working the experimental alloys suggests that other processes known in the art may be used to produce products of this invention.

Table 3 presents data obtained from a variety of compositions. The alloys were generally within the ranges shown in Table 2 except for the variation of molybdenum and chromium as indicated in Table 3.

These data show the need to critically control not only the composition ranges but also the ratios between molybdenum and chromium.

Table 3 presents the microstructural analysis of the experimental alloys. The ordering phases were observed after aging at 1200° F. for only 24 hours. It is well known in the art that the aging times to obtain hardness for alloys of the $A_2B$ class are generally well over 1000 hours.

The data in Table 3 clearly show that alloys containing less than 31% total molybdenum plus chromium (Alloys X—X) do not have the desired aging characteristics although the Mo:Cr ratios are within the 2 to about 4 range.

TABLE 3

| | | | | MICROSTRUCTURAL ANALYSIS | |
|---|---|---|---|---|---|
| ALLOY | COMPOSITION | | MO + CR | ORDERING PHASES AFTER AGING AT 1200° F./24 HR. | MO:CR RATIO |
| X-X | 21-23 MO | 5-8 CR | 26-31 | NONE (NO HARDENING) | 4.2 TO 2.9 |
| *1 | 27 MO | 5 CR | 32 | $A_2B$ | 5.400 |
| *2 | 25 MO | 8 CR | 33 | $A_2B$ | 3.125 |
| *3 | 23 MO | 10 CR | 33 | $A_2B$ + $NI_4MO$ | 3.400 |
| *4 | 27 MO | 8 CR | 35 | $A_2B$ + $NI_4MO$ | 3.375 |
| *5 | 29 MO | 8 CR | 37 | $A_2B$ + $NI_3MO$ | 3.625 |
| *6 | 27 MO | 10 CR | 37 | $A_2B$ + $NI_4MO$ | 2.700 |
| *7 | 25 MO | 12 CR | 37 | $A_2B$ + $NI_4MO$ | 2.0833 |

*ALLOYS OF THIS INVENTION

The data further show that alloy 1 which contains 32% total Mo+Cr and has a Mo:Cr ratio of 5.4, has a desirable $A_2B$ ordering phase; however, other deleterious phases form during long-term aging. Thus, this alloy may be useful in short term operations, such as rockets and the like.

Alloys 2, 3, 4, 5 and 6 are alloys within the scope of this invention, the total contents and ratios of molybdenum and chromium are over 31% and between 2 to 4, respectively.

Alloy 7 is within the broad scope of the invention for some uses, for reasons similar to the alloy 1 discussed above.

The data presented in Table 3 clearly emphasizes the need for a critically controlled balance between molybdenum plus tungsten and chromium. When either the total or ratio of molybdenum plus tungsten and chromium are near or at the limit of the ranges, then the desired engineering characteristics are marginal.

For the most part the class of superalloys, relating to the alloy of this invention, require a very critical low mean coefficient of thermal expansion. FIG. 1 presents the comparative coefficient of thermal expansion for various alloys known in the art and the alloy of this invention.

The alloy of this invention, alloy 2, appears to rate favorably with the alloys now used in the art. For use at higher temperatures, alloys 8 and 10 generally, require a coating for protection against oxidation while alloy 2 has inherent oxidation resistance and needs no coating.

As a further test to determine the optimum molybdenum content, a series of tests were performed. The molybdenum content was experimentally varied from about 21% to about 29% in a basic nickel base containing 8% chromium.

Thermal expansion data were obtained for the alloys (1) from room temperature (78° F.) to 1000° F. and (2) from room temperature (78° F.) to 1200° F. The data as reported in FIG. 2, indicate that the more predictable coefficient is expected with the molybdenum content ranging within about 22 to 30% with the optimum between about 24 to 26% molybdenum.

The alloys of this invention obtain their ordering phases (and hardness) after only 24 hours at 1200° F. This is a valuable improvement in the art. Other alloys of this class (i.e., Hastelloy® alloy S) must be heat-treated about 500 to 1000 hours at temperatures 1000° to 1100° F. Hastelloy is a registered trademark of Haynes International, Inc.

The alloy of this invention was tested for thermal stability together with Hastelloy alloy B which is used as a low thermal expansion alloy. Alloy B, nominally containing about 28 molybdenum and less than 1% chromium as an impurity, has been especially known for its corrosion resistance in hydrochloric acid since about 1938. The alloys were tested in the Charpy impact testing machine in the form of V-notch test bars. The test results are given in Table 4. It is obvious that the alloy of this invention retains a high degree of impact strength stability after 1000 and 4000 hours.

TABLE 4

THERMAL STABILITY OF ALLOY 2 IN COMPARISON WITH ALLOY B

| ALLOY | MATERIAL CONDITION | ROOM TEMPERATURE CHRPY V-NOTCH IMPACT TOUGHNESS (FT-LBS) |
|---|---|---|
| 2 | AGED 1200° F./24 HR. | 68 |
| | AGED 1200° F./1000 HR. | 43 |
| | AGED 1200° F./4000 HR. | 32 |
| B | ANNEALED | 88 |
| | AGED 1200° F./1000 HR. | 28 |
| | AGED 1200° F./4000 HR. | 6 |

The strength of the alloys of this invention were compared to certain low thermal expansion alloys known in the art. Alloy S, as disclosed in U.S. Pat. No. 4,118,223, nominally contains about 16% chromium, 15% molybdenum, 0.5% silicon, 0.8% manganese, 0.04% lanthanum. The alloy is well known in the art as a thermally stable alloy. Results of room temperature tensile test are presented in Table 5. The data clearly show the alloy of this invention to be as good as or better than other alloys now used in the art. Although alloy 10 has good tensile strength properties, the ductility of the alloy (elongation) is low.

A series of tests were conducted to study the oxidation properties of experimental alloys. Included were selected prior art alloys and alloy 2, the alloy of this invention. The alloys were exposed in air at 1500° F. for a total of 1008 hours. Group I was cycled every 24 hours while Group II was cycled every 168 hours. As shown in Table 6, the test results in metal loss, and in maximum metal affected clearly show alloy 2 to be virtually unharmed by the oxidation exposure. Alloys X, N and S were only slightly harmed. Alloy B was a little more damaged. Clearly, alloy 10 was the most damaged. For this reason alloy 10 has to be coated when used in oxidizing conditions.

Because the production of the alloy of this invention was relatively trouble-free, it is expected that the alloy may be produced by most well-known processes. Furthermore, the casting and

TABLE 5

ROOM TEMPERATURE TENSILE PROPERTIES OF VARIOUS ALLOYS

| ALLOY | 0.2% Y.S. (KSI) | U.T.S. (KSI) | % EL |
|---|---|---|---|
| S | 55.6 | 123.1 | 55 |
| B | 56.0 | 127.0 | 52 |
| 10 | 147.9 | 190.4 | 16 |
| 2 | 100–125 | 173–193 | 35–43 |

KSI - 1000 POUNDS PER SQUARE INCH

TABLE 6

OXIDATION TEST DATA OF VARIOUS ALLOYS 1500° F./1008 HOUR OXIDATION TESTS

| ALLOY | METAL LOSS (MILS) | MAX. METAL AFFECTED (MILS) |
|---|---|---|
| | I. 24 HOUR CYCLE | |
| 10 | 4.4 | 19.4 |
| 2 | 0 | 0.5 |
| B | 7.2 | 8.2 |
| X | 0.1 | 1.1 |
| N | 0.4 | 1.2 |
| S | 0 | 0.5 |
| | II. 168 HOUR CYCLE | |
| 10 | 3.4 | 15.2 |
| 2 | 0 | 0 |
| B | 1.2 | 1.7 |
| X | 0.1 | 0.8 |
| S | 0 | 0.5 |

MAX. METAL AFFECTED = METAL LOSS + MAX. INTERNAL ATTACK working characteristics of the alloy clearly indicate that the alloy may be produced in a great variety of commercial forms including castings, wires, wrought products, powders, welding and hardfacing products and the like.

It will be apparent to those skilled in the art that the novel principles of the invention disclosed herein in connection with specific examples thereof will support various other modifications and applications of the same. It is accordingly desired that, in construing the breadth of the appended claims, they shall not be limited to the specific examples of the invention described.

What is claimed is:

1. A nickel-base alloy having a low coefficient of thermal expansion consisting essentially of, in weight percent, up to 0.3 carbon, 5 to 12 chromium, 10 to 30 molybdenum, 22 to 40 molybdenum plus tungsten, 1 maximum aluminum, trace to 0.015 boron, 5 maximum iron, 2 maximum manganese, 1.2 maximum silicon, 0.1 maximum rare earth metals, balance nickel plus normal impurities wherein the ratio of Mo+W:Cr is between 2:1 and 7:1 to provide a favorable combination of properties and wherein the chromium plus molybdenum content exceeds 31 to obtain optimum ordering characteristics.

2. The alloy of claim 1 containing 0.02 to 0.06 carbon, 7 to 9 chromium, 10 to 26 molybdenum, 22 to 40 molybdenum plus tungsten, 0.5 maximum aluminum, 0.002 to 0.006 boron, 2 maximum iron, 0.8 maximum each manganese and silicon, 0.07 maximum rare earth metals and the ratio of Mo+W:Cr is between 2:1 and 6:1.

3. The alloy of claim 1 containing about 0.04 carbon, about 8 chromium, about 25 molybdenum, about 0.2 aluminum, about 0.003 boron, about 1 iron, about 0.5 manganese, about 0.4 silicon, about 0.03 rare earth metals and the ratio of Mo+W:Cr is about 3:1.

* * * * *